United States Patent [19]

Chen et al.

[11] Patent Number: 4,971,766

[45] Date of Patent: Nov. 20, 1990

[54] APPARATUS FOR FCC PROCESS WITH CATALYST SEPARATION

[75] Inventors: Nai Y. Chen, Titusville; Billy K. Huh, Lawrenceville, both of N.J.; Thomas E. Degnan, Yardley, Pa.

[73] Assignee: Mobil Oil Corporation, New York, N.Y.

[21] Appl. No.: 437,064

[22] Filed: Nov. 16, 1989

Related U.S. Application Data

[62] Division of Ser. No. 206,240, Jun. 10, 1988, Pat. No. 4,895,636.

[51] Int. Cl.[5] ..... B01J 8/18

[52] U.S. Cl. ..... 422/144; 422/145; 422/147

[58] Field of Search ..... 422/144, 145, 147, 139

[56] References Cited

U.S. PATENT DOCUMENTS 2,742,403 4/1956 Nicholson et al. ..... 196/49
2,763,599 9/1956 Abeel, Jr. et al. ..... 422/144 X
2,890,168 6/1959 Smith ..... 422/144 X
3,846,280 11/1974 Owen et al. ..... 422/144 X

*Primary Examiner*—Robert J. Warden
*Assistant Examiner*—Amalia L. Santiago
*Attorney, Agent, or Firm*—Alexander J. McKillop; Charles J. Speciale; Richard D. Stone

[57] ABSTRACT

An FCC or fluidized catalytic cracking process and apparatus for converting heavy metals laden crudes is disclosed. The heavy feed, conventional catalyst and an additive or vanadium getter contact the feed in a riser reactor. The additive is segregated from conventional FCC catalyst upstream of the conventional FCC regenerator. An elutriating, upflow riser reactor may be used with a coarse, rapidly settling getter. A fine, slowly settling getter may be used, with getter segregation achieved by using an elutriating cyclone on the riser outlet, an elutriating catalyst stripper, a sieve, or the like. The spent getter may be used once through, regenerated in a separate getter regenerator, or used as a source of fuel. Alumina and sponge coke are preferred getters.

6 Claims, 2 Drawing Sheets

APPARATUS FOR FCC PROCESS WITH CATALYST SEPARATION

"This is a divisional of copending application Ser. No. 206,240, filed on Jun. 10, 1988, and now U.S. Pat. No. 4,895,636."

The FCC, or fluidized catalytic cracking process, is a mature process. It is used to convert relatively heavy, usually distillable, feeds to more valuable lighter products. There is an increasing need in modern refineries to convert more of the "bottom of the barrel", e.g., resids or residual oil fractions to more valuable lighter products.

In the past these heavy streams were subjected to various thermal processes such as coking or visbreaking to convert them to more valuable products. Unfortunately, thermal processing alone has not proved to be a complete answer to the problem, as the products of thermal cracking are themselves relatively low valued products, such as heavy fuel oil from visbreaking or coker naphtha or coker gas oil from coking operations.

Residual oils have a large percentage of refractory components such as polycyclic aromatics which are difficult to crack. Resids also contain large amounts of metals which rapidly deactivate conventional catalyst. Some attempts at catalytic processing of these stocks have been made, e.g., adding relatively small amounts of residual oil to conventional FCC feed. FCC units can tolerate modest amounts of resids in the feed, e.g., 5–10 wt percent but the heavy feeds increase the burning load on the regenerator (because of their high Conradson carbon content) and poison the catalyst, with nickel and vanadium. Limiting the amount of resid in the FCC feed has been the method of choice in controlling regeneration temperature, although consideration has been given to adding catalyst coolers. The nickel and vanadium contamination problem can be overcome to some extent by practicing metals passivation, e.g., addition of antimony to the unit to passivate the metals added with the feed. Metals passivation has allowed FCC units to continue operating with catalyst containing relatively high amounts of nickel and vanadium, but has not been a complete solution. Nickel is passivated, but vanadium remains as a poison. The vanadium seems to attack the zeolite structure of FCC catalyst, resulting in rapid loss of catalyst activity. The exact cause of vanadium poisoning is not completely understood, but it is believed that pentavalent vanadium compounds are formed in the highly oxidizing atmosphere of conventional FCC regenerators. These compounds, particularly vanadic acid, rapidly attack the zeolite. The problem of vanadium contamination in FCC catalyst is discussed in S. G. Jones, Applied Catalysis 2, 207 (1982).

Most refiners now monitor the metals concentration on their catalyst and dump equilibrium catalyst and replace it with fresh catalyst to control the average level of metal on the catalyst. Such a solution is expensive because it requires very high catalyst replacement rates.

Another approach to adding residual oils to FCC units is described in U.S. Pat. No. 3,886,060, which is incorporated herein by reference. Residual oil was used as a quench medium to limit the conversion of a recycle oil in a riser conversion zone. The preferred catalysts had dual components, i.e., contained both large and small pore size zeolites. A single regenerator operated with dual riser reactors.

Despite the many improvements which have been made, attempts to crack resids have not been too successful, primarily because of the large amounts of metal and coke associated with such feeds. We have now discovered a way to handle such difficult stocks in a single riser reactor, using two regenerators. Our approach uses a mixture of conventional zeolite containing FCC catalyst and a coarse or very fine amorphous additive in a single riser reactor with a two stage regenerator to achieve some unusual results.

By careful selection of the catalyst sizes and of the superficial vapor velocities in the riser reactor, catalyst and coarse additive can be effectively segregated upstream of the regenerator. The additive catalyst is regenerated under relatively mild conditions which minimize oxidation of vanadium compounds. The additive preferably absorbs or accepts most of the metals in the feed. The zeolite containing FCC catalyst is conventionally regenerated. This use of two different kinds of catalyst, and two regenerators, permits significantly higher metals levels to be tolerated in the feed than was heretofore possible.

BRIEF SUMMARY OF THE INVENTION

Accordingly the present invention provides in a fluidized catalytic cracking process for converting of heavy, metals laden crude oil to lighter products wherein heavy metals laden crude contacts a zeolite containing FCC catalyst in a catalytic riser reactor, catalyst and cracked products are separated at the cracking reactor outlet, the catalyst is stripped to remove strippable hydrocarbons therefrom and the stripped catalyst is regenerated with an oxygen containing gas and recycled to the cracking reactor zone to recontact additional feed, the improvement which comprises using a mixture of conventional FCC catalyst and a metal scavenging or 'getter material' which is separable from the FCC catalyst by elutriation, removing a majority of the metals in the FCC feed by depositing them on the 'getter' material and separating conventional FCC catalyst from 'getter' material before the conventional catalyst enters the FCC regenerator.

DETAILED DESCRIPTION

Getter Material

Figure 1:
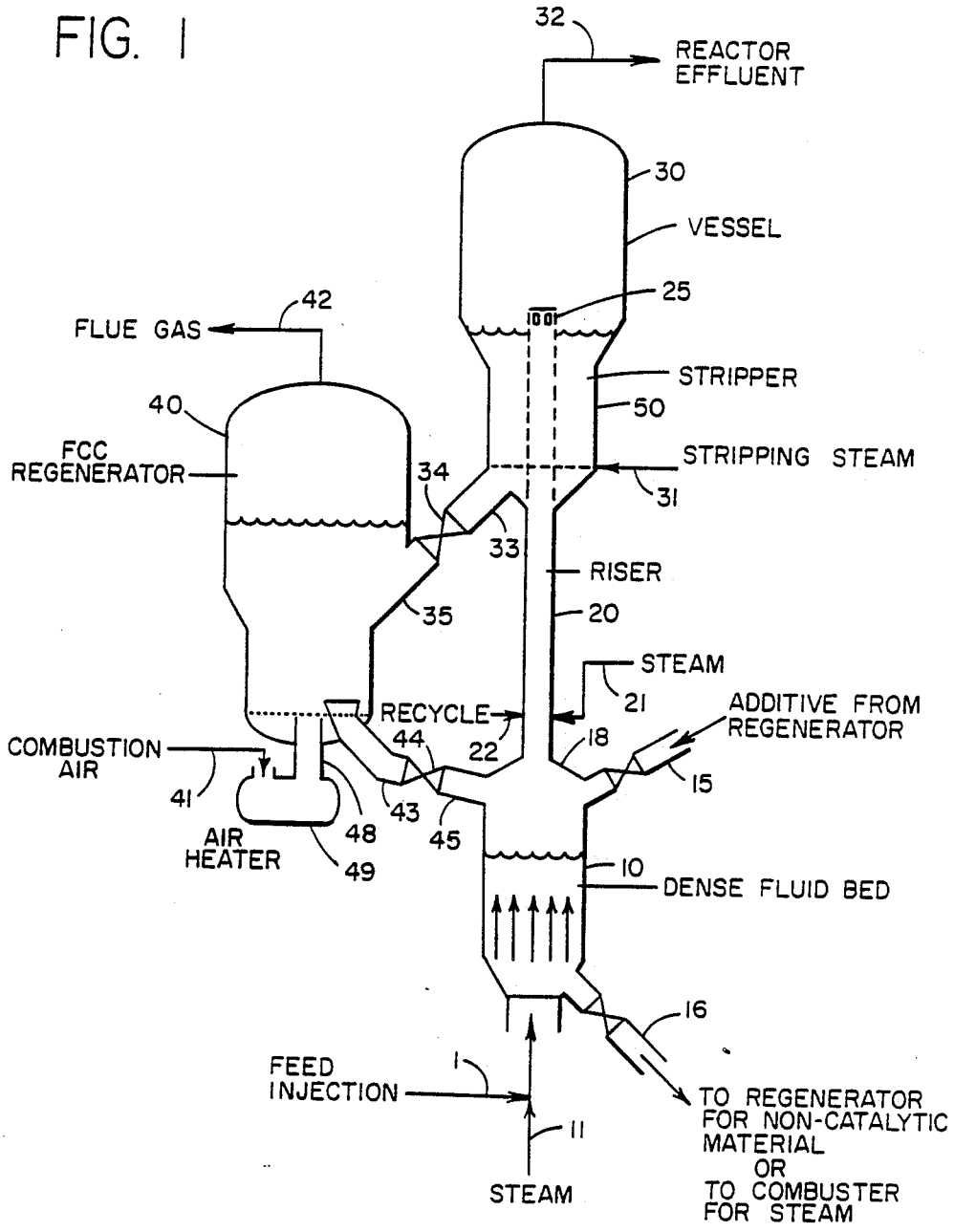
FIG. 1 is a simplified, schematic flow diagram of an embodiment of the invention using a relatively heavy getter material.

The getter material must have certain chemical properties (primarily an affinity for vanadium) and certain physical properties (that permit segregation of 'getter material' from conventional catalyst upstream of the regenerator).

The getter material should have a greater affinity for metals such as nickel and vanadium than the conventional FCC catalyst. Any material which will preferentially adsorb particularly vanadium or nickel (and to a lesser extent sodium) may be used in the present invention. The getter material need not have significant catalytic cracking activity. Its function is to adsorb metal contaminants that would otherwise accumulate on the conventional catalytic cracking catalyst. The getter material will therefore adsorb metals and therefore prevent them from damaging the zeolite. It is essential to minimize the residence time of the getter in the conventional FCC regenerator. It is beneficial to minimize the contact time of the getter with the feed in the reaction zone. The effective residence time of feed in contact with metal in the cracking reaction can be minimized by using a relatively heavy getter material, in the base of a riser reactor. This will mean that only 5–10% by length of the riser reactor will be devoted to demetallation. Expressed as hydrocarbon residence time at cracking conditions, less than 25% of the reaction zone should be devoted to removal of metals.

Depending on the feed properties, and the heat balance requirements of the unit, an extremely long residence time of getter material in the base or elutriating section of the riser may be tolerated. This is because the heavy crudes contemplated for use herein rapidly deposit hydrocarbonaceous coke on catalyst (or getter material). This coke is itself a very efficient metal absorber. Thus, it is also contemplated to use herein a heavy getter material which as a virgin material has little activity for demetallation, but which acquires the desired properties during use. As the getter accumulates coke, this newly formed coke has a higher affinity for metals than the conventional FCC catalyst.

Relatively light, low density getters are also contemplated for use herein. Such materials cannot, in a conventional riser reactor, be separated by elutriation at the base of the riser. The light getters must remain with the catalyst through the entire length of the riser. Light getter materials will have a slightly shorter residence time in the reactor than the conventional catalyst, because the conventional catalyst will have a somewhat higher settling velocity.

It is essential that the light getter materials, when used, have a relatively greater affinity for metals than the catalyst, preferably an order of magnitude more affinity. This is fairly easy to achieve because the light getter materials can be of very fine particle size, (e.g., less than 20 microns) and can be selected solely for their metals affinity characteristics.

When using a light or fine getter material, a relatively large amount of this material will be lost per pass through the reactor. This is because the light material will tend to be blown out with reactor effluent, or, if some of it is comingled with conventional catalyst charged to the conventional regenerator, will be recovered with the flue gas. This relatively high loss of getter additive is beneficial, as this material should be removed from the unit once it becomes contaminated with metals.

The physical properties of the heavy, or coarse, getter material are listed below:

| | COARSE GETTER | | |
|---|---|---|---|
| Physical Properties | Suitable | Preferred | Most Preferred |
| Particle Size, microns | 80–500 | 200–500 | 400 |
| Particle Density g/cc | 0.8–2.2 | 1.5–2.2 | 1.5–2.0 |
| Pore Volume, cc/g | 0.2–0.4 | 0.2–0.4 | 0.2–0.4 |

The physical properties of the light getter material are shown below.

| | FINE GETTER | | |
|---|---|---|---|
| Physical Properties | Suitable | Preferred | Most Preferred |
| Partical Size, microns | 10–50 | 10–40 | 20–40 |

-continued

| | FINE GETTER | | |
|---|---|---|---|
| Physical Properties | Suitable | Preferred | Most Preferred |
| Density g/cc | 0.7–1.5 | 0.7–1.3 | 0.7–1.3 |
| Pore Volume cc/g | 0.5–1.2 | 0.5–1.2 | 0.5–1.2 |

CHEMICAL PROPERTIES

Regardless of whether a relatively coarse or fine material is used as the getter, the chemical properties of the getter can be the same.

The preferred chemical properties of the getter material are that is have a low surface free energy (e.g., less than 5.0 microns/g-mole) and that is have a surface area greater than 5 $m^2$/gram and lower surface energies (Gg) than the FCC catalyst. Any conventional getter material now used, or hereafter developed, can be used in the practice of the present invention. Alumina, sponge coke and magnesium salts are preferred getter materials.

Also contemplated for use herein, especially as heavy getter materials, are spent, but preferably regenerated, catalyst removed from refinery hydroprocessing units. Typical of such materials would be hydrodesulfurization catalyst, especially those used on heavier charge stocks. These hydroprocessing catalysts are utterly unsuitable for use in conventional catalytic cracking units (because of the high metals content) but they will still function very well as a vanadium sink in the process of the present invention. There are several other advantages to using these materials. They are usually readily available within refineries and already represent a disposal problem (because of the high metals content on the catalyst). The problem of disposing of these spent hydroprocessing catalysts is not made any worse by depositing additional nickel and vanadium upon them. In fact, because of the heightened metals levels, the spent catalysts become slightly more valuable for possible downstream metals recovery operations. Use of metals contaminated hydroprocessing catalyst on an alumina binder is especially preferred. Catalysts with a large amount of metals deposited on them already seem to function even more efficiently as getter materials for removing metals from heavy crudes.

These heavy hydroprocessing catalysts can, by grinding, also be made suitable for use as a light getter additive. Some grinding or crushing or equivalent treatment will be beneficial for "heavy" getter to make it more easily fluidizable.

Catalyst "fines" such as those obtained when hydrotreated catalyst is dumped, screened and replaced, are an excellent material for use in the present invention.

ELUTRIATING RISER REACTOR

The base of the riser reactor can be an elutriating section, as shown in FIG. 1 of the drawing. The "hourglass shape" shown is one easy way of achieving a significant change in superficial vapor velocity which will cause conventional catalyst to be swept up the riser while allowing the heavy, getter additive to settle back down to the base of the riser to perform its demetallation function.

The relative diameter of the base of the riser at the elutriating section and the diameter of the conventional riser reactor can be determined based on the laws of physics, and the expected flows therethrough, to result in efficient partitioning of conventional catalyst from heavy getter material.

It is possible to have an elutriating base riser section, even without a constriction in riser diameter. Extremely dense, or relatively large, getter particles can remain in the base of the riser at the superficial vapor velocities used in normal practice. The superficial vapor velocity in the riser will also increase rapidly between the base section (where much feed vaporization occurs, and a limited amount of cracking) and slightly higher up in the riser. Thus, there is a significant velocity gradient in the base of the riser, which occurs independently of the diameter of the riser. When an elutriating base section is used, the superficial vapor velocity in it may be 30–90% of the superficial vapor velocity in that portion of the riser just downstream of the elutriating base section.

Downflow Riser Reactor

Although a riser reactor is shown in the Figures, it is also possible, and may be preferable in some instances, to operate with a downflow riser reactor.

When using a downflow riser reactor it will not be possible to segregate getter material from conventional catalyst near the riser inlet. The only feasible means of separation is an elutriating cyclone at the riser outlet, or an elutriating catalyst stripper intermediate the reactor outlet and the conventional regenerator.

RISER CYCLONE ELUTRIATION

Figure 2:
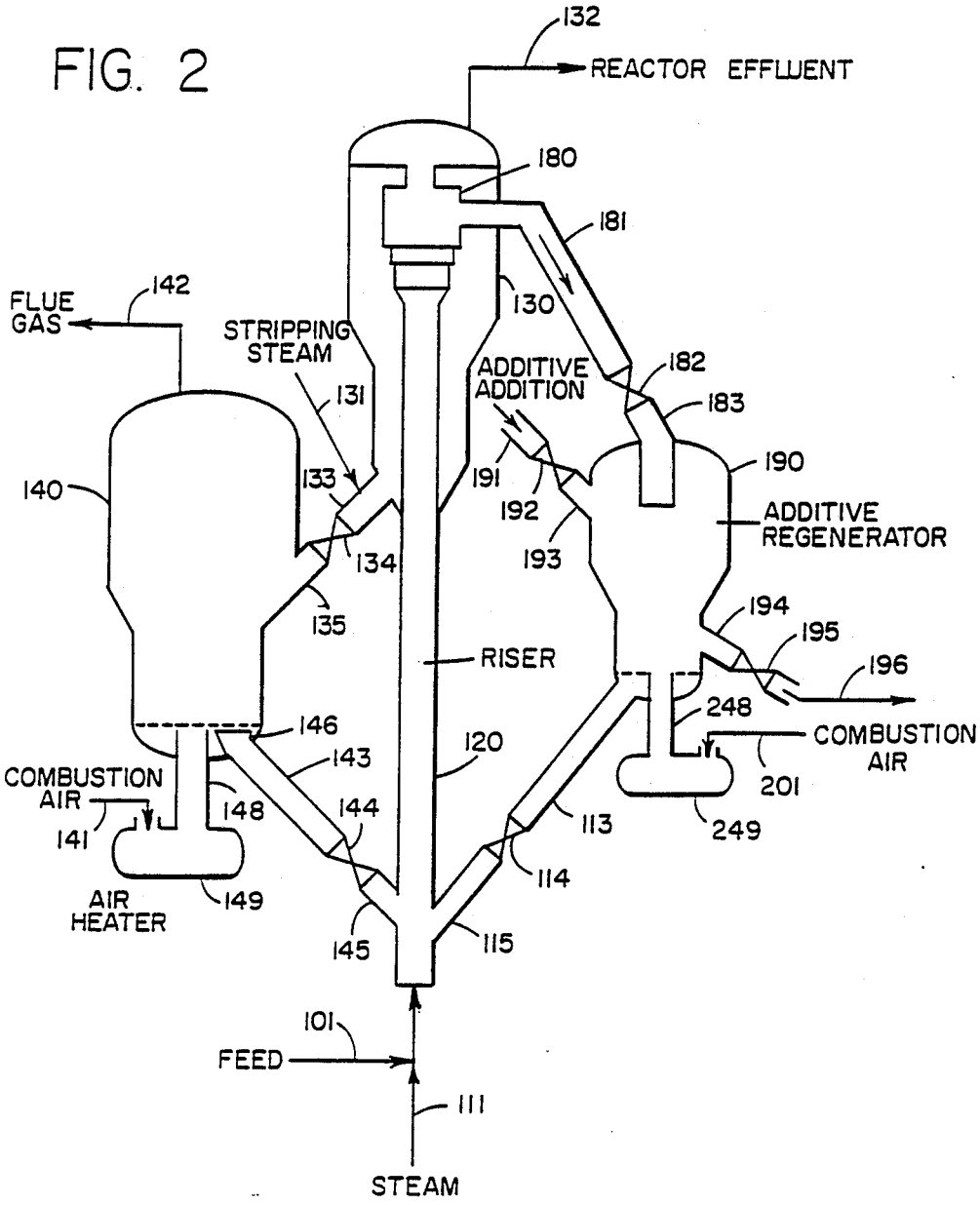
FIG. 2 is a schematic diagram of an FCC process of the invention using a fine getter material.

As shown in FIG. 2, discharging the riser outlet into an elutriating cyclone is an efficient way to separate cracked products from conventional catalyst and from the additive catalyst. Although the Figure shows only a single, large, elutriating cyclone, it is possible to achieve separation by having several cyclone separators in a series. The first cyclone separator, attached directly to the riser outlet, would recover the fastest settling material, which will be the conventional catalyst when a light, low density getter is used as an additive. The vapor discharge from the first cyclone may be sent to a second cyclone separator, to recover fine getter and catalyst fines, or to the reactor vessel containing the cyclones.

The approach taken in U.S. Pat. No. 4,490,241 Chou, incorporated herein by reference, may also be used. In this patent a light additive was used which was collected in secondary cyclones downstream of the riser reactor.

Catalyst Stripper

The present invention should have a conventional catalyst stripping zone. The catalyst stripping zone may also function as an elutriating stripper to separate additive catalyst from conventional catalyst by sieving, difference in settling velocities, or by relying on density differences which promote catalyst segregation in fluidized beds, or by other equivalent means.

Conventional FCC Catalyst

Conventional FCC catalysts are zeolitic. Most FCC's use zeolitic catalyst, typically a large pore zeolite, in a matrix which may or may not possess catalytic activity. These zeolites typically have crystallographic pore dimensions of 7.0 angstroms and above for their major pore opening. Zeolites which can be used in cracking catalysts include zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752) to name a few, and naturally occurring zeolites such as chabazite, faujasite, mordenite, and the like. Silicon-substituted zeolites, described in U.S. Pat. No. 4,503,023 can also be used.

Two or more of the large pore crystalline cracking catalysts can be used as the conventional catalyst. Preferred conventional catalysts are the natural zeolites mordenite and faujasite and the synthetic zeolites X and Y with particular preference given zeolites Y, REY, USY and RE-USY.

Such conventional FCC catalysts are well known.

Catalyst Regeneration

The conditions in the FCC catalyst regenerator are conventional. U.S. Pat. No. 4,116,814 (and many other patents) discuss regeneration conditions. U.S. Pat. No. 4,116,814 is incorporated by reference.

Getter Regenerator

Although not shown in FIG. 1, the getter material, whether dense or light, is preferably subjected to a regeneration step in a separate regenerator.

Ideally the regeneration is a relatively mild one, occurring under reducing conditions so that the regenerator temperatures are not too high. This will mean that a CO combustion boiler, or some means of dealing with a CO rich flue gas must be provided.

It is also possible to operate with complete CO combustion in the getter regenerator. There are advantages and disadvantages to this type of operation. The advantages are that no CO boiler is needed, and some passivation of nickel is achieved by complete CO combustion. The disadvantage is that the high temperatures and high oxygen partial pressure usually encountered will lead to more rapid deactivation of the getter material and will oxidize the vanadium to the pentavalent state which will make it more likely to attack the zeolite based catalyst.

In the embodiment shown in FIG. 2, the relatively light, readily elutriable getter is regenerated.

The invention can be better understood by reference to the Figures.

FIG. 1 is a schematic view of one embodiment of the invention, using a relatively heavy getter material.

A heavy, metals laden feed is added via line 1, mixed with steam from line 11, and charged into dense fluid bed 10 where it contacts relatively coarse particles of getter additive. The getter additive is added from a regenerator, not shown, via line 15. The additive is withdrawn via line 16 for regeneration. Once through use of additive is also contemplated, so the regeneration can be eliminated.

Conventional hot regenerated FCC catalyst is added to the base of riser reactor 20. The hot catalyst may be added via line 43, control valve 44 and inlet line 45 to the top of the dense fluid bed section 10, as shown in the drawing, or it may be added to a lower portion of the dense fluid bed 10 to assist in vaporizing the feed.

Vaporized feed, which has been substantially demetallized, and hot regenerated catalyst pass up through transition section 18 into riser 20. Recycle hydrocarbon streams may be added via line 22. Additional steam may be added via line 21 to assist in fluidization and reduce hydrocarbon partial pressure. The mixture of catalyst and cracked products exits riser 20 via outlet 25 in reactor vessel 30. Catalyst is collected in the lower portion of this vessel, designated stripper 50, and contacts stripping steam added via line 31. Stripped catalyst is removed via lines 33, valve 34 and line 35 and charged to conventional FCC regenerator 40.

In regenerator 40 combustion air from line 41 may be passed through optional air heater 49 (usually used only for startups) and discharged via line 48 into the base of the regenerator. Flue gas is removed via line 42. Hot regenerated catalyst is withdrawn via inlet 46 and lines 43 and valve 44 for reuse.

Although a single dense bed regenerator is shown in FIG. 1, other conventional FCC regenerators may be used, e.g., minimum inventory regenerators comprising a dense bed coke combuster, a superimposed dilute phase transport riser and a second dense bed for collection of hot regenerated catalyst.

Cracked products are removed from vessel 30 via line 32 and charged to conventional product recovery means, e.g., wet gas compressor, gas plant etc.

FIG. 2 shows another embodiment of the invention using a light getter material. A heavy hydrocarbon feed is added via line 101, mixed with steam from line 111 and charged to the base of riser 120. The feed contacts hot regenerated conventional FCC catalyst added via line 145 and a relatively light getter material added via line 115. The mixture of feed, catalyst, and getter material passes up through the riser and discharges into elutriating riser cyclone 180. Cracked products are removed overhead via line 132. Some light catalyst particles, and the bulk of the getter material, are separately discharged from the cyclone via line 181, while the heavier, in this instance conventional, catalyst particles are discharged down to the base of vessel 130. The catalyst is subjected to conventional steam stripping with steam added via line 131. Stripped conventional catalyst is charged via line 133, valve 134 and line 135 into conventional regenerator 140. Combustion air is added via line 141, heater 149 (usually used only during start up) and line 148 to burn coke on catalyst. Flue gas is removed via line 142. Hot regenerated catalyst is withdrawn via inlet 146 and line 143, valve 144 and line 145 and recycled to the base of the riser.

The light getter material recovered from the cyclone via line 181 is passed through valve 182 and line 183 to the getter regenerator 190. Combustion is added via line 201, passed through optional preheater 249 and line 248 into vessel 190 to burn off carbonaceous material.

Fresh getter material may be added via line 191, valve 192 and line 193 into the regenerator 190. Material may be withdrawn from vessel 190 via line 194, valve 195 and line 196 where desired. If the metals level is high some getter material may be removed and replaced to keep the desired metals content on circulating getter material. Hot, decarbonized getter material is removed via line 113, valve 114 and line 115 and charged to the base of the riser 120 for reuse.

EXAMPLES

The following examples are laboratory tests of various parts of the process. All of the tests conducted herein were conducted with a conventional FCC catalyst, an Arab light gas oil feed doped with 0.5 weight percent vanadium, and various getter materials, in a laboratory sized apparatus.

CONVENTIONAL FCC CATALYST

The catalyst used was a sample of commercially used equilibrium catalyst of 140/170 mesh size, i.e., it would pass through a size 140 mesh screen and be retained on a size 170 mesh screen. This corresponds roughly to an average diameter of 80 to 105 microns.

Conventional FCC catalyst usually has a particle size of 10–80 microns, with most of it in the 40–80 micron range.

PHYSICAL PROPERTIES

The physical (and some catalytic) properties of the commercial equilibrium FS-30 Catalyst are as follows:

| | | | |
|---|---|---|---|
| 1 | Catalyst Coke | 78003623 | 78003623 |
| 2 | Pilot Unit No. | 0 | 0 |
| 3 | Pilot Run No. | 0 | 0 |
| 4 | Catalyst Cond. Code | 41 | 41 |
| 5 | Repeat No. | 1 | 1 |
| 10 | Ash at Method F | — | 97.25 |
| 11 | Packed Density, g/cc | — | 0.9600 |
| 12 | Loose Density, g/cc | — | 0.8700 |
| 14 | Real Density, g/cc | — | 2.7780 |
| 15 | Particle Density, g/cc | — | 1.8710 |
| 16 | Pore Vol., cc/g | — | 0.37 |
| 19 | Surface Area M2/g | — | 113.00 |
| 20 | Carbon On Cat., Wt % | — | 0.17 |
| 26 | Alumina, 2–100 Wt % | — | 43.20 |
| 27 | Silica, 0–100 Wt % | — | 53.00 |
| 29 | Total Rare Earths, Wt% | — | 2.95 |
| 39 | REY X-Ray Cryst., Wt % | — | 14.90 |
| 43 | Nickel, (0.002–5+)/PPM | — | 470.00 |
| 44 | Vanadium (0.0025–10+)/PPM | — | 1460.00 |
| 45 | Antimony (0.025–10+)/PPM | — | 29.00 |
| 50 | Iron, (0.002–5+)/PPM | — | 0.55 |
| 56 | Copper, (0.005–5+)/PPM | — | 80.00 |
| 60 | 0–20 MCRN Size Vol. % | — | 0.00 |
| 61 | 20–40 Vol. % | — | 7.10 |
| 62 | 40–60 Vol. % | — | 35.80 |
| 63 | 60–80 Vol. % | — | 32.10 |
| 64 | 80+Vol. % | — | 25.00 |
| 65 | Median MCRN Size | — | 63.70 |
| 90 | Cat As Rec'd Conv. Vol. % | 64.96 | — |
| 91 | Cat As Rec'd Gasol. Vol. % | 54.53 | — |
| 92 | Cat as Rec'd C4's Vol. % | 11.74 | — |
| 93 | Cat as Rec'd Dry Gas. Wt % | 5.90 | — |
| 94 | Cat as Rec'd Coke, Wt. % | 0.98 | — |
| 95 | Cat as Rec'd H2 Factor | 71.64 | — |
| 96 | Cat as Rec'd Letgo | 0.61 | — |
| 97 | Cat as Rec'd FAI Test No. | 1746556 | — |
| 100 | Cat Cln Brnd Conv., Vol. % | 70.41 | 68.59 |
| 101 | Cat Cln Brnd Gasol., Vol. % | 60.55 | 57.27 |
| 102 | Cat Cln Brnd C4's Vol. % | 15.02 | 11.85 |
| 103 | Cat Cln Brnd Dry Gas, Wt. % | 3.93 | 6.78 |
| 104 | Cat Cln Brnd Coke, Wt. % | 1.35 | 1.26 |
| 105 | Cat Cln Brnd H2 Factor | 79.25 | 69.08 |
| 106 | Cat Cln Brnd C Letgo | 0.61 | 0.27 |
| 107 | Cat Cln Brnd FAI Test No. | 1746563 | 1746563 |
| 111 | Sample No. 1 | — | 84023034 |

Getter Material

The following getter additives were used:

| Getter | Source-Physical Properties |
|---|---|
| MgO | Mallinckrodt |
| $Al_2O_3$ | Alpha products p = 3.965 g/cc |
| Magnesium Silicate | $(Mg\ 3H_2\ (SiO_3)_4$ |
| CPG | 80/m mm |
| (Controlled Pore Glass) | Per diam 1273 A |
| | SA: 24 $m^2/g$ |
| CPG | 80/m |
| | Per diam 116A |
| | SA: 155 $m^2/g$ |
| $SiO_2$—$Al_2O_3$ (F19933) | FCC catalyst matrix |

Feed

Arab light vacuum gas oil (83D-4516) was doped with vanadyl-naphthenate (ICN pharmaceuticals) to 0.43 wt % V.

This feed is much lighter than the feeds normally contemplated for use herein. Normally the feed will be a resid, such as short resid or long resid, and will contain much higher levels of Conradson carbon and heavy materials. The resid feeds contemplated for use herein will usually not be doped with additional vanadium, they will already have too much nickel and vanadium already present to allow their processing in conventional FCC units.

REACTION CONDITION

Reactions were carried out in a dense fluidized bed at 500° C., 1 LHSV, 5900 SCF/B helium with loadings of 5 grams each of catalyst and substrate solid. In order to facilitate the separation of catalyst and substrate following the run, different particle size ranges were used for each pair of materials. In the following, the catalyst is defined as the component containing a zeolite function while the substrate is a porous solid with no zeolite function. Nominal particle size ranges of 180 to 425 microns diameter and 85 to 100 microns diameters were utilized in this study, and the particles remained essentially intact during the run. The duration of each run was usually 10 min. except where the metal partitioning was examined as a function of time. During each 10 min. pumping interval 0.01 grams of vanadium was charged to the reactor. In our experiments we observed very little vanadium (less than 10 ppm) in any of the liquid products indicating that vanadium was removed very efficiently in the dense fluid bed.

Kce is defined as ratio of the absolute concentration of coke normalized with respect to external surface area.

Both Kv and Kc are partitioning coefficients calculated based solely on the weight of the different additives or getter materials used. Surface area effects are ignored.

Kve and Kce are calculations reflecting the ratios of surface area available in the additive vs surface area available in the conventional catalyst.

RESULTS AND DISCUSSION

Table 1 shows results of metal and coke partitioning between the series of catalyst and substrate mixtures. The partitioning coefficient K denotes ratio of the absolute concentration of vanadium or coke on the substrate material to that on the catalyst. The subscripts v and c stand for vanadium and coke, respectively. A K value equal to 1 would represent an equal distribution of vanadium or coke between the substrate and the catalyst.

Kve and Kce are the ratios of partitioning coefficients which have been normalized with respect to the external surface area of each component, respectively. A sample calculation of Kve and Kce for the FCC/$Al_2O_3$ mixture is shown below. The amount of vanadium accumulated on the equilibrium FCC catalyst from a commercial unit and the $SiO_2$–$Al_2O_3$ matrices (Table 1) was determined by measuring the difference between the initial and final vanadium contents of the catalysts.

Partitioning Coefficient Calculation

FCC Catalyst
Mesh Size: 140/170 (mean diameter=97 microns)
Particle Density: 1.095 g/cc

TABLE 1

| | | Metal and Coke Partitioning | | | | | | |
|---|---|---|---|---|---|---|---|---|
| | | BET Surface | Vanadium | Coke | Vanadium | | Coke | |
| Catalyst/Inert | Mesh Size | Area ($m^2/g$) | (ppm) | (%) | Kv | Kve | Kc | Kce |
| Equilibrium FCC | 140/170 | 117 | 5 | 1.30 | 50.8 | 206.0 | 1.5 | 6.2 |
| $Al_2O_3$ | 40/80 | 267 | 254 | 2.00 | | | | |
| Equilibrium FCC | 140/170 | 117 | 43 | 0.92 | 3.9 | 8.9 | 3.1 | 7.0 |
| $Mg_2(SiO_2)_3$ | 40/80 | 569 | 169 | 2.86 | | | | |
| Equilibrium FCC | 140/170 | 117 | 537 | 2.55 | 1.4 | 5.1 | — | — |
| Joliet Shot Coke | 40/80 | 5 | 729 | — | | | | |
| Equilibrium FCC | 140/170 | 117 | 10 | 19.70 | 17.5 | 48.9 | — | — |
| Joliet Sponge Coke | 60/80 | 5 | 175 | — | — | — | | |
| Equilibrium FCC | 140/170 | 117 | 78 | 0.005 | 1.9 | 6.6 | 93 | 328.0 |
| $SiO_2$ | 40/80 | 1019 | 145 | 0.465 | | | | |
| Equilibrium FCC | 140/170 | 117 | 230 | 3.31 | 3.5 | 2.5 | 1.1 | 0.8 |
| CPG-A | 200/400 | 204 | 807 | 3.57 | | | | |
| Equilibrium FCC | 140/170 | 117 | 157 | 1.60 | 0.5 | 0.9 | 0.3 | 0.6 |
| CPG-B | 80/100 | 155 | 73 | 0.53 | | | | |
| Equilibrium FCC | 140/170 | 117 | 22 | 2.09 | 7.0 | 13.5 | 0.8 | 1.5 |
| CPG-C | 80/100 | 24 | 154 | 1.61 | | | | |
| Equilibrium FCC | 140/170 | 177 | 222 | 2.33 | 1.1 | 4.0 | 0.5 | 1.7 |
| MGO | 40/80 | 31 | 254 | 1.14 | | | | |

In Table 1, the vanadium partitioning data are reported in two ways, Kv and Kve.

Kv is defined as ratio of the absolute concentration of vanadium on substrate/catalyst.

Kve is defined as ratio of the absolute concentration of vanadium normalized with respect to external surface area.

Coke partitioning data are also reported in two ways, Kc and Kce.

Kc is defined as ratio of the absolute concentration of coke on substrate/catalyst.

$$\text{External surface area/gram sample} = (\text{volume of sample/gram}) \times (\text{ext. surface area of a particle})$$
$$= [(1/p)/(4\,r^3)] \times [4\,r^2]$$
$$= 3/pr$$
$$= 6/pd$$
$$= 6/(1.095\ \text{g/cc})(97 \times 10^{-6}\ \text{m}) \times (100\ \text{cm}/_2\text{m})$$
$$= 0.056\ \text{m}^2/\text{gram}$$

Alumina
Mesh Size: 40/80 (d=302.5 microns)
Particle Density: 1.427 g/cc $$\text{External surface area} = 6/(1.427)(302.5 \times 10^{-6})(10^2\ \text{cm/m})^3$$
$$= 0.0139\ \text{m}^2/\text{gm}$$

From Table 1 the vanadium contents for FCC catalyst and alumina are 5 and 254 ppm respectively. Hence the partitioning coefficient is $$Kve = (252/0.0139)/(5/0.056)$$
$$= 206$$

Similarly, for the coke $$Kce = (2/0.0139)/(1.3/0.056)$$
$$= 6.2$$

VANADIUM PARTITIONING

For a dense fluid bed consisting of two components, the selective uptake of vanadium may depend on the size and the density of each of the components, the particle surface area, as well as the surface metal affinities. We will address the influence of these effects on the vanadium partitioning between the catalyst and porous substrate.

In our bench scale fluid bed, the size and density of the particles influence the mixing of the two component system. At a given fluidizing velocity heavier particles tend to remain on the bottom of the bed while more readily fluidizable component remains on the top leading to the stratification of two materials. The effect of such a non-uniform two-component bed is to mimic two stage demetallation units and allow vanadium to deposit on the first component it sees. At typical FCC conditions (538° C.), thermal reactions alone are sufficient to crack vanadium containing porphyrin or naphthene structures to permit metal deposition. Table 1 shows that the absolute concentration of vanadium is usually higher on larger particles than on the smaller ones. For example, higher vanadium concentrations were observed on the larger particles from both $NaY/Al_2O_3$ and $USY/Al_2O_3$ runs when the mean particle sizes of cracking catalysts and substrates were reversed from 300 to 92 microns and vice versa.

Consequently, in our system, the metal partitioning is a weak function of either the total (BET) or the external surface areas of particles. There is no correlation between the relative metal uptake level and the surface area of substrates, and the particles with higher surface area do not necessarily show higher capacity for the metals. Table 1 shows that the Kv value of $SiO_2$, which has over 200 times the BET surface area and nearly the same external area as Joliet Sponge Coke, is merely one-tenth that of the sponge coke. This indicates that, in addition to the particle size effect, the surface metal affinity (rather than surface area) may play a vital role in determining the metal partitioning.

Indeed, the particle size and the first contact phenomenon are not the major factors determining metal partitioning. As shown in Table 1, when the particle sizes of catalyst and substrate for the $USY/Al_2O_3$ mixture were reversed, the ratio of vanadium on the larger to that on the smaller particle does not stay the same. This ratio is nearly seven-fold higher for the large $Al_2O_3$ than the large USY system. That is, if both the catalyst and $Al_2O_3$ substrate particles were of equivalent size the $Al_2O_3$ substrate would show much higher capacity for the vanadium than the catalyst. Hence, in addition to the physical nature of the system (e.g., particle size effect) the enhanced metal partitioning is attributed to the higher affinity of $Al_2O_3$ for the vanadium than the USY. Also these values indicate that NaY has higher affinity for vanadium than USY.

Among the solid substrates examined in combination with commercial equilibrium FCC catalyst, alumina and sponge coke exhibit high vanadium affinity. As shown by the partitioning coefficient, Kv, vanadium concentrations on sponge coke and alumina are 18 and 50 times greater, respectively, than that on the commercial equilibrium catalyst. The differences are even larger when normalized with respect to the external surface areas as shown by Kve values. Under the similar reaction conditions, the metal concentrations on the $SiO_2$ and Controlled-Pore Glass are much lower, with coefficients in the order of 0.5 to 7.

The intrinsic surface properties of each of the solids (e.g., metal affinity) are quite different. When the surface free energies of three available materials were compared with their external partitioning coefficients, an interesting correlation was noted.

TABLE 2

| Solids | Surface Free Energies* $G_f$ at 500 C. (kcal/g-mole) |
|---|---|
| $Al_2O_3$ | −15.58 |
| $SiO_2$ | −11.20 |
| MgO | 7.60 |

*CRC Handbook of Material Science, Vol. 1, 1974.

As shown in Table 2, the order of increasing surface free energy is $Al_2O_3$, followed by $SiO_2$ and MgO at −15.58, −11.20, and −7.6 kcal/mole, respectively. Coincidentally, when these materials are mixed with commercial equilibrium FCC catalyst, the order of decreasing metal partitioning coefficient is $Al_2O_3$, $SiO_2$, and MgO. Hence, the vanadium appears to prefer surfaces of lower free energies.

The results in Table 1 show that all silica-based materials have poor affinities for vanadium. Aside from silica itself, the metal partitioning coefficient of Controlled-Pore Glass (a silica derivative) is 30 to 200 fold less than that of the alumina, and more significantly, the coefficients for the matrix of silica-alumina are two to three orders of magnitude lower than that of alumina. Thus, the lower affinity for vanadium on the silica containing material offers an incentive to utilize physical mixture of silica-bound REY and alumina or, if necessary, Si- $O_2$–$Al_2O_3$ in the FCC applications. This combination may reduce the metal deposition and significantly extend zeolite life.

COKE PARTITIONING

The coke formation is a function of catalyst acidity. Therefore, the coke concentration is expected to be higher on the FCC catalyst than on the substrate solids. Indeed, Table 1 shows that more acidic USY produces a higher level of coke than either NaY or commercial equilibrium FCC catalyst, and the coke partitioning is not affected by the particle stratification. Both USY and NaY catalysts, when mixed with differently sized $Al_2O_3$ particles, show a higher affinity for coke, and this trend is clearly independent of the vanadium partitioning.

Alumina is an excellent getter material for use herein, as shown by the test of the conventional FCC catalyst with 40/80 mesh $Al_2O_3$ in Table 1.

Silica shows relatively poor affinity for the vanadium. Silica derivatives, such as CPG (controlled-pore-glass) also exhibit low selectivity and capacity for vanadium.

If we were designing a new FCC unit now to practice the invention, we would use the embodiment of FIG. 1.

We would use a conventionally sized FCC catalyst, but would prefer to use one with little alumina in the matrix, i.e., a 12–15% REY zeolite in a silica matrix.

We would use alumina, or coke or magnesium silicate, with an average particle size greater than 80 microns, preferably around 150 microns.

We would use a riser reactor with a relatively constant cross section at the base, i.e., there would be no widened base section.

What is claimed is:

1. An apparatus for the fluidized catalystic cracking (FCC) of a heavy, metals laden oil feed to lighter products comprising:

a catalytic riser reactor means having an inlet in a base thereof connected with a source of hot, regenerated FCC catalyst, a source of said heavy feed, and a source of a metal scavenger which is separable from said FCC catalyst by physical means, and which produces a metal and coke contaminated scavenger and a mixture of cracked product vapor and coke deactivated FCC catalyst and which discharges via an outlet in an upper portion thereof said mixture of cracked product vapor and coke deactivated FCC catalyst;

a vapor/catalyst separation means connective with said riser reactor outlet and for separating said mixture into a cracked product vapor rich vapor stream and a coke deactivated FCC catalyst rich stream;

a catalyst regeneration means having an inlet for coke deactivated FCC catalyst connected to said vapor/catalyst separation means, an inlet for combustion air, an outlet for flue gas, and an outlet for regenerated catalyst which is connected to said riser reactor inlet; and an FCC catalyst/scavenger separation means located intermediate said base of said riser reactor and said FCC catalyst regeneration means for separating said scavenger from said FCC catalyst, and recycle said scavenger to said base of said riser reactor without passage of said scavenger through said catalyst regeneration means.

2. The apparatus of claim 1 wherein the riser reactor has an enlarged base section for segregating FCC catalyst from scavenger by elutriation.

3. The apparatus of claim 1 wherein the riser reactor has an outlet which discharges into a cyclone separation means for segregating conventional FCC catalyst from scavenger and produce an FCC catalyst rich stream which is discharged to said catalyst regeneration means and a scavenger rich stream which is recycled to said riser inlet.

4. The apparatus of claim 1 further comprising a means for regenerating said scavenger and having a scavenger regenerator inlet connected to said FCC catalyst/scavenger separation means located intermediate said base of said riser reactor and said FCC catalyst regeneration means, an inlet for scavenger regeneration gas, an outlet for scavenger flue gas, and an outlet for regenerated scavenger connected to said base of said riser reactor.

5. The apparatus of claim 4 wherein the riser reactor has an outlet which discharges into a cyclone separation means for segregating conventional FCC catalyst from scavenger and produce an FCC catalyst rich stream which is discharged to said catalyst regeneration means and a scavenger rich stream which is charged to said scavenger regeneration means.

6. The apparatus of claim 4 wherein the riser reactor has an enlarged base section for segregating FCC catalyst from scavenger by elutriation by allowing scavenger to settle back down to the base of the riser and said riser base has a scavenger outlet connected to said scavenger regenerator inlet.

* * * * *